US008939444B2

(12) United States Patent
Omori

(10) Patent No.: US 8,939,444 B2
(45) Date of Patent: Jan. 27, 2015

(54) PRINTING APPARATUS AND CONTROL METHOD FOR PRINTING APPARATUS

(71) Applicant: Canon Kabushiki Kaisha, Tokyo (JP)

(72) Inventor: Yohei Omori, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/022,738

(22) Filed: Sep. 10, 2013

(65) Prior Publication Data

US 2014/0077438 A1 Mar. 20, 2014

(30) Foreign Application Priority Data

Sep. 14, 2012 (JP) ..... 2012-202639

(51) Int. Cl.

| | |
|---|---|
| ***B65H 5/00*** | (2006.01) |
| ***B65H 29/00*** | (2006.01) |
| ***B41J 13/10*** | (2006.01) |
| ***B65H 31/02*** | (2006.01) |
| ***G03G 15/00*** | (2006.01) |

(52) U.S. Cl.

CPC ..... *B65H 29/00* (2013.01); *B41J 13/106* (2013.01); *B65H 31/02* (2013.01); *G03G 15/6552* (2013.01); *B65H 2405/1117* (2013.01); *B65H 2511/515* (2013.01); *B65H 2513/50* (2013.01); *B65H 2601/521* (2013.01); *B65H 2801/12* (2013.01)

USPC ..... 271/10.04; 271/265.01; 271/266; 271/306; 271/176; 271/213; 271/10.13

(58) Field of Classification Search

CPC ..... B65H 3/06; B65H 3/0669; B65H 3/063; B65H 2403/72

USPC ..... 271/266, 306, 176, 207, 213, 265.01, 271/10.04, 10.12, 10.13

See application file for complete search history.

(56) References Cited

U.S. PATENT DOCUMENTS

| | | | | |
|---|---|---|---|---|
| 7,281,791 | B2 * | 10/2007 | Anami et al. | 347/104 |
| 7,905,482 | B2 * | 3/2011 | Matsumoto | 271/213 |
| 7,976,020 | B2 | 7/2011 | Awai | |
| 8,336,872 | B2 * | 12/2012 | Liu | 271/10.13 |
| 2005/0082742 | A1 * | 4/2005 | Kang et al. | 271/121 |
| 2009/0295082 | A1 * | 12/2009 | Awai | 271/306 |
| 2012/0051824 | A1 | 3/2012 | Omori | |

FOREIGN PATENT DOCUMENTS

| | | | | |
|---|---|---|---|---|
| JP | 01271353 A | * | 10/1989 | B65H 29/22 |
| JP | 06135617 A | * | 5/1994 | B65H 31/34 |
| JP | 2010-006608 A | | 1/2010 | |

* cited by examiner

*Primary Examiner* — Prasad Gokhale

(74) *Attorney, Agent, or Firm* — Fitzpatrick, Cella, Harper & Scinto

(57) ABSTRACT

The printing apparatus of the present invention includes a delay mechanism that can transmit, with a delay, the rotational force of a discharge roller to a discharge tray. When the reverse rotation of the discharging roller has been begun, the delay mechanism accumulates the length of the delay, or, when the forward rotation of the discharge roller is performed for a longer period than the accumulated length of the delay, opens the discharge tray. When the feeding of a sheet is not performed during a sheet feeding operation accompanied by the reverse rotation of the discharging roller, the discharging roller is rotated forward to cancel out the length of the delay accumulated in the delay mechanism.

5 Claims, 8 Drawing Sheets

PRINTING APPARATUS AND CONTROL METHOD FOR PRINTING APPARATUS

BACKGROUND OF THE INVENTION

1. Field of the Invention

The present invention relates to a printing apparatus, equipped with a tray that is pivotally mounted between an open and a closed positions in order to hold printed sheets, and a control method for the printing apparatus.

2. Description of the Related Art

Generally, a tray (a discharge tray) wherein printed sheets of a material (e.g., printed sheets of paper) are held is provided for a printing apparatus. Such a discharge tray is pivotally mounted on a rotary shaft, between an open and a closed position, and can be closed when not in use, both to reduce the external size of the printing apparatus and to prevent foreign matter, such as dust, from entering and degrading the function of the printing component of the apparatus. However, when printing is inadvertently begun while the discharge tray is closed, the discharge tray will interfere with the discharge of printed sheets, and internal printing apparatus problems, such as paper jams, will occur.

To avoid this problem, a printing apparatus proposed in Japanese Patent Laid-Open No. 2010-6608 includes a control mechanism, whereby a discharge tray is automatically opened when the printing of sheets is performed and the rotation of discharging rollers is begun. The control mechanism includes a delay mechanism that provides a predetermined delay before the rotation of the discharging roller is transmitted to the discharge tray. Further, at present, like a printing apparatus disclosed in Japanese Patent Laid-Open No. 2010-6608, the same drive source is employed for a conveying roller and a discharging roller to reduce the size and the manufacturing cost of the printing apparatus.

However, according to the printing apparatus described in Japanese Patent Laid-Open No. 2010-6608, which includes a discharge tray delay mechanism, in a case wherein an error has occurred under the condition whereby the length of delay is accumulated in the delay mechanism, even when the error has been corrected, and printing is thereafter restarted, the timing for the opening of the discharge tray may not be appropriate. This occurs, for example, during an operation whereby the printing apparatus corrects the positional deviation of a sheet of paper by causing the leading edge of the sheet to abut against a reversely rotating conveying roller. At this time, when the same drive source is employed for the conveying roller and the discharging roller, as described above, the discharging roller is also reversely rotated in association with the reverse rotation of the conveying roller, and the length of the delay is accumulated in the discharge tray delay mechanism. Assume that under a condition such that the length of a delay is accumulated, the printing apparatus is halted due, for example, to an "Out of Paper" error. In this case, when the error has been corrected and the feeding of paper is sequentially restarted, as in the normal state, the discharge tray may be opened later than the intended time because of the length of the accumulated delay.

In a case wherein the discharge tray is opened following a delay, as described above, the following problem would occur.

(1) A sheet of paper to be delivered may be bent by striking the discharge tray in the closed state.

(2) The discharging roller is rotated at a low speed at the opening timing for the discharge tray; however, since the opening timing is delayed, the discharging roller will be rotated at a high speed that is appropriate for printing, and as a result, the discharge tray will be opened suddenly and rapidly.

SUMMARY OF THE INVENTION

One objective of the present invention is to provide a printing apparatus wherein, in a case wherein an error has occurred while the length of a delay is being accumulated in a discharge tray mechanism, a discharge tray can be opened at an appropriate timing during the printing operation performed following the correction of the error.

To achieve this objective, the present invention includes the following arrangement. Specifically, according to the present invention, a printing apparatus comprising:

a sheet feeding unit for feeding a sheet;

a printing unit for printing the sheet fed by the sheet feeding unit;

a discharging roller for rotating forward and discharging outside a main body of the printing apparatus a sheet that has been printed by the printing unit;

a discharge tray that is pivotally mounted on the main body, between an open position and a closed position, for holding sheets that are discharged outside the main body; and a delay mechanism for providing a delay before transmitting a rotational force, for the discharging roller, to the discharge tray, wherein, when the discharging roller is rotated in reverse, the delay mechanism accumulates the length of a delay, or when the discharging roller is rotated forward for a period longer than the length of a delay that has been accumulated, opens the discharge tray, and wherein, when feeding of a sheet to the conveying path is not performed during a sheet feeding operation that is accompanied by reverse rotation of the discharging roller, the length of the delay that has been accumulated in the delay mechanism during forward rotation of the discharging roller is canceled out.

According to the printing apparatus of this invention, which is equipped with the control mechanism that includes the discharge tray delay mechanism, even when an error has occurred in the state wherein the length of a delay has been accumulated, the discharge tray can be opened at an intended timing during the printing operation performed after the error has been corrected.

Further features of the present invention will become apparent from the following description of exemplary embodiments (with reference to the attached drawings).

DESCRIPTION OF THE EMBODIMENTS

One embodiment of the present invention will now be described in detail while referring to the accompanying drawings. In the following explanation, a printing apparatus that employs an ink jet printing system (an ink jet printing apparatus) is employed.

Figure 1A:
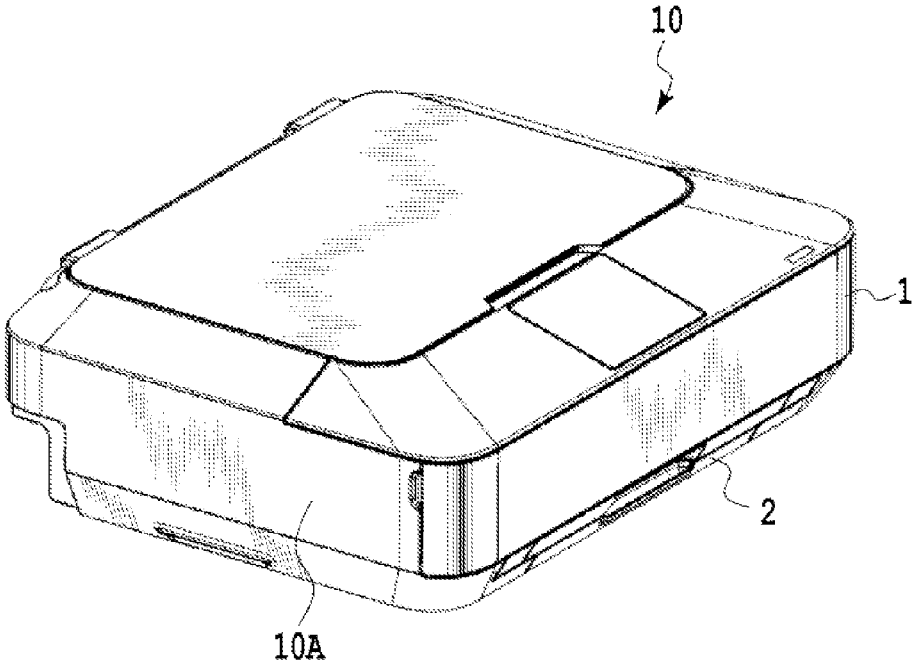
FIGS. 1A and 1B are perspective views of the external appearance of a printing apparatus according to one embodiment of the present invention.
Figure 1B:
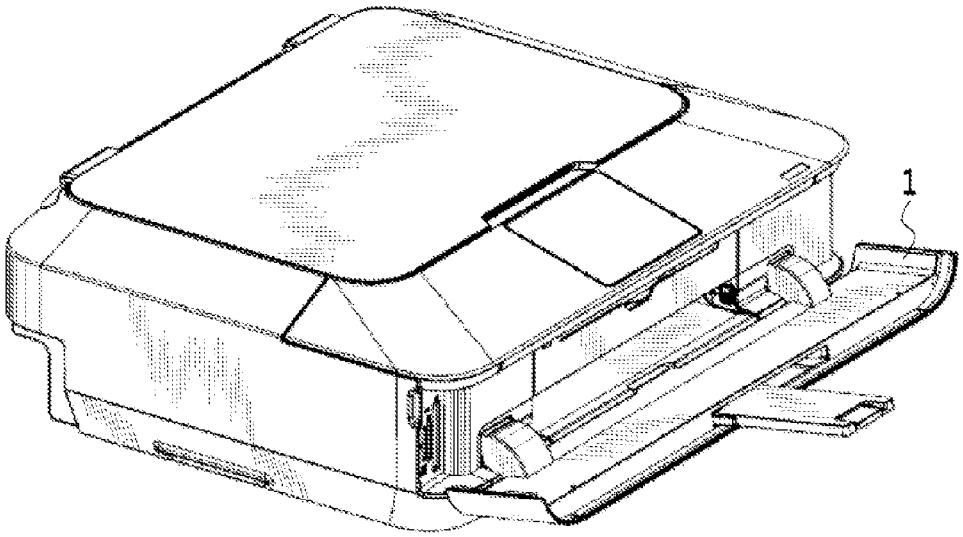

FIGS. 1A and 1B are perspective views of the external appearance of a printing apparatus 10 according to this embodiment. For the printing apparatus 10 of the embodiment, a discharge tray 1 is mounted, at the front of a box-shaped main body 10A, so pivotal between an open position and a closed position. In the state shown in FIG. 1A, the discharge tray 1 is closed, while in the state shown in FIG. 1B, the discharge tray 1 is open.

Figure 2:
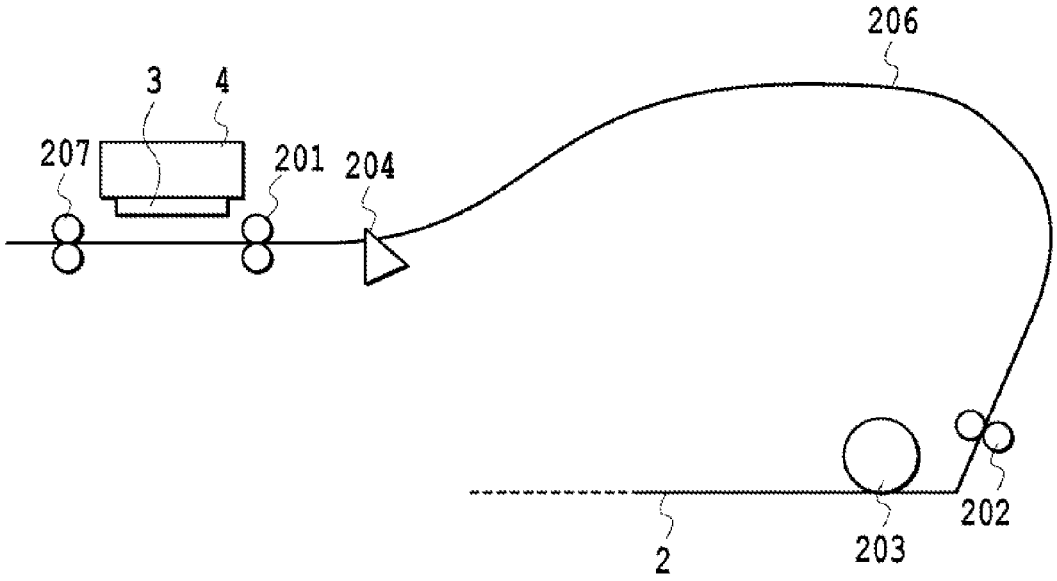
FIG. 2 is a schematic cross-sectional view of the arrangement of the individual rollers and a sheet conveying path for the printing apparatus of the embodiment.

FIG. 2 is a schematic cross-sectional view of the arrangement of the individual rollers and a sheet conveying path for the printing apparatus 10 of this embodiment. As shown in FIG. 2, the printing apparatus 10 includes a sheet stacking unit 2, a sheet feeding unit, a print head (a printing unit) 3, a carriage 4 and a recovery unit (not shown).

The recovery unit is a mechanism that maintains a preferable ejection condition for the print head 3, and includes a cap used to protect the print head 3 from becoming dry, a wiper used to wipe the surface of the print head 3, and a pump, connected to the cap via a valve, for drawing in ink using suction.

The sheet feeding unit is a mechanism that performs a sheet feeding operation in which, after sheets have been picked up, one by one, from the sheet stacking unit 2 by a pickup roller 203, the individual sheets are fed to the print head 3 along a conveying path 206. The sheet feeding unit includes a sheet feeding roller 202, a conveying roller 201 and a discharging roller 207. In this embodiment, the discharging roller 207, the conveying roller 201, the sheet feeding roller 202 and the pickup roller 203 are linked with a single conveying motor 301 via a train of gears, and the same drive source is employed. The conveying roller 201 is located upstream of the print head 3 in a sheet conveyance direction, while the discharging roller 207 is located downstream of the print head 3. A gear ratio for the conveying roller 201 and the discharging roller 207 is 1:1, and a gear ratio for the conveying roller 201 and the sheet feeding roller 202 is 1:1.

As for the rotational directions of the individual rollers, assuming that the individual rollers rotate forward when a sheet is conveyed from the sheet stacking unit 2 to the print head 3, the discharging roller 207 rotates forward during the forward rotation of the conveying roller 201, and at this time, the sheet feeding roller 202 also rotates forward. Further, during the reverse rotation of the conveying roller 201, the discharging roller 207 rotates in the reverse direction, while the sheet feeding roller 202 rotates forward.

A PE lever 204 is arranged immediately upstream of the conveying roller 201, and when a sheet is conveyed, the PE lever 204 is pushed down by the leading edge of the sheet. When the PE lever 204 is pushed down, the PE lever 204 blocks the light reception path for a PE sensor 205, which is a photointerrupter, and as a result, a predetermined output signal (an ON signal) is output. Therefore, it can be ascertained that the leading edge of the sheet has reached the position where the PE lever 204 is located. When conveying of the sheet is continued, the trailing edge of the sheet passes across the PE lever 204 that was pushed down, and thus, the PE lever 204 is restored to the original state before being pushed down by the sheet. Therefore, based on a signal (an OFF signal) output by the PE sensor 205, passage of the trailing end of the sheet can also be identified.

Figure 3:
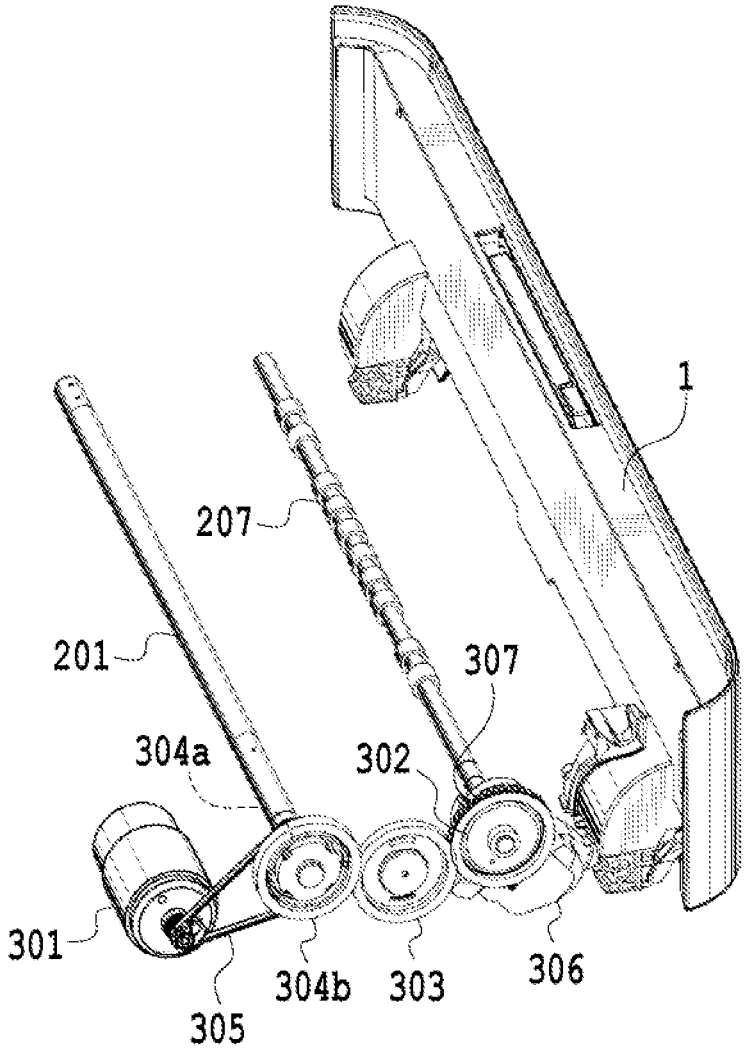
FIG. 3 is a perspective view of the mechanism of the printing apparatus of the embodiment from a conveying motor to a discharge tray.

Furthermore, in this embodiment, the discharge unit, which discharges a printed sheet, includes the above described discharging roller 207 and the discharge tray 1. FIG. 3 is a perspective view of the driving system of the discharge unit. As shown in FIG. 3, in this embodiment, the conveying motor 301 is employed as a drive source for the conveying roller 201 and the discharging roller 207. That is, the drive force provided by the conveying motor 301 is transmitted via a belt 305 to a conveying pulley 304*a* that is fixed to the conveying roller 201. As a result, the conveying roller 201 and a conveying roller gear 304*b* fitted thereto are rotated. The rotations of the conveying roller gear 304*b* are transmitted via an idler gear 303 to a discharging roller gear 302. Since the discharging roller gear 302 is fixed to the discharging roller 207, the discharging roller 207 is rotated with the discharging roller gear 302. Therefore, when the conveying motor 301 rotates forward, the conveying roller 201 is rotated in a direction in which the sheet is to be delivered to the discharge tray 1. Further, when the conveying motor 301 is reversely rotated, the conveying roller 201 is rotated in a direction in which the sheet is to be pulled to the inside of the main body 10A.

The discharge tray 1 is opened or closed by being pivoted at the rotation shaft (not shown) provided at the front lower portion of the main body 10A. Near the rotation shaft of the discharge tray 1, a rotary lever 306 is provided with a linking member, and is to be rotated with the discharge tray 1. Further, a discharging roller cam 307, shaped as shown in FIG. 4, is coaxially supported with the discharging roller 207, so as to be rotatable.

Figure 6A:
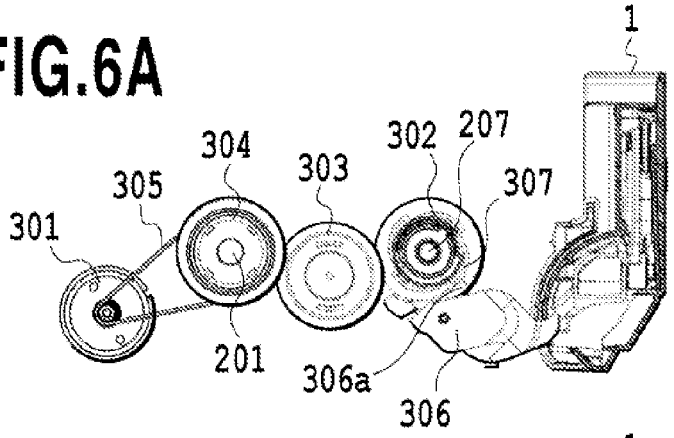
FIGS. 6A to 6D are side views for explaining the operation, performed by the mechanism shown in FIG. 3, until the closed discharge tray is open.
Figure 6B:
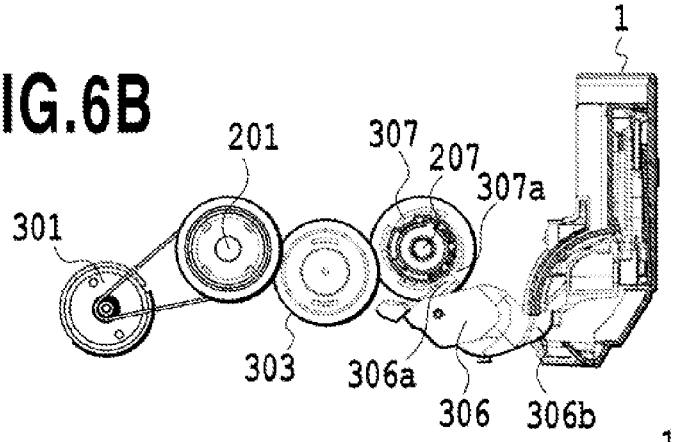
Figure 6C:
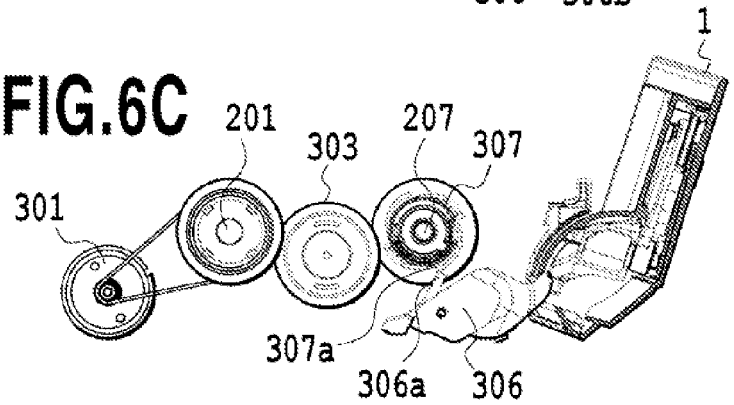
Figure 6D:
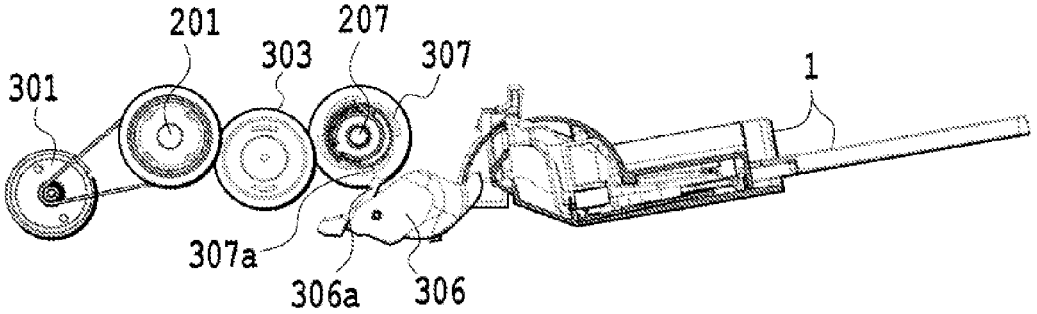

The relationship between the rotary lever 306 and the discharge roller cam 307 is shown in FIGS. 6A to 6D. When the discharge tray 1 is at the closed position, the rotary lever 306 contacts the outer face of the discharging roller cam 307 (see FIG. 6A). At this time, when the conveying motor 301 rotates forward to rotate the discharging roller cam 307 forward at the rotational axis (clockwise rotation in FIG. 6A), a cam face 307*a* of the discharging roller cam 307 is brought into contact with one end of the rotary lever 306, and pushes this end down. As a result, the rotary lever 306 is rotated counterclockwise in FIG. 6A, and the other end of the rotary lever 306 pushes the discharge tray 1 up. Therefore, as shown in FIG. 6C, the discharge tray 1 is pushed by the other end of the rotary lever 306 and is rotated at the rotation shaft, until finally reaching the open position, as shown in FIG. 6D.

In a case wherein the discharge tray 1 is at the closed position, and the discharging roller cam 307 is reversely rotated (counterclockwise rotation in FIG. 6A), the cam face 307*a* is not brought into contact with the rotary lever 306, and therefore, the rotary lever 306 does not rotate, and the discharge tray 1 will not be open. Further, in the state shown in FIG. 6D, where the discharge tray 1 is open, the rotary lever 306 does not contact the discharging roller cam 307, and therefore, the discharging roller cam 307 and the rotary lever 306 will not be operated together.

Figure 4:
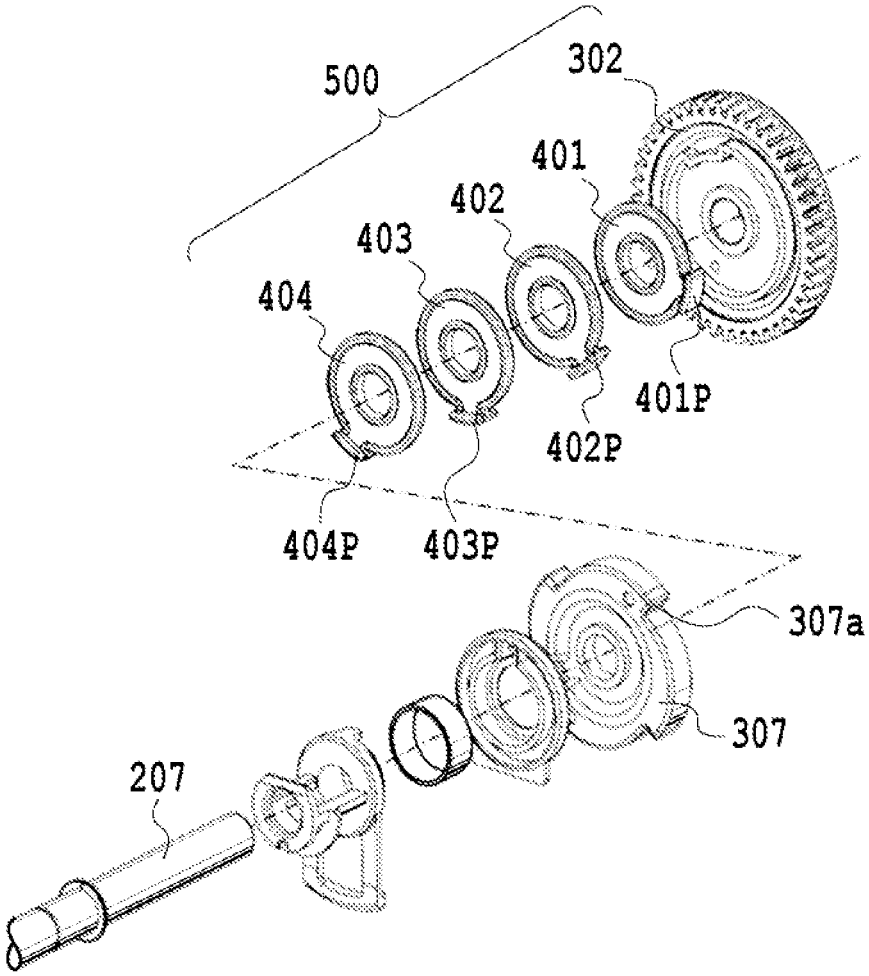
FIG. 4 is a perspective view of the delay mechanism of the printing apparatus of the embodiment.
Figure 5:
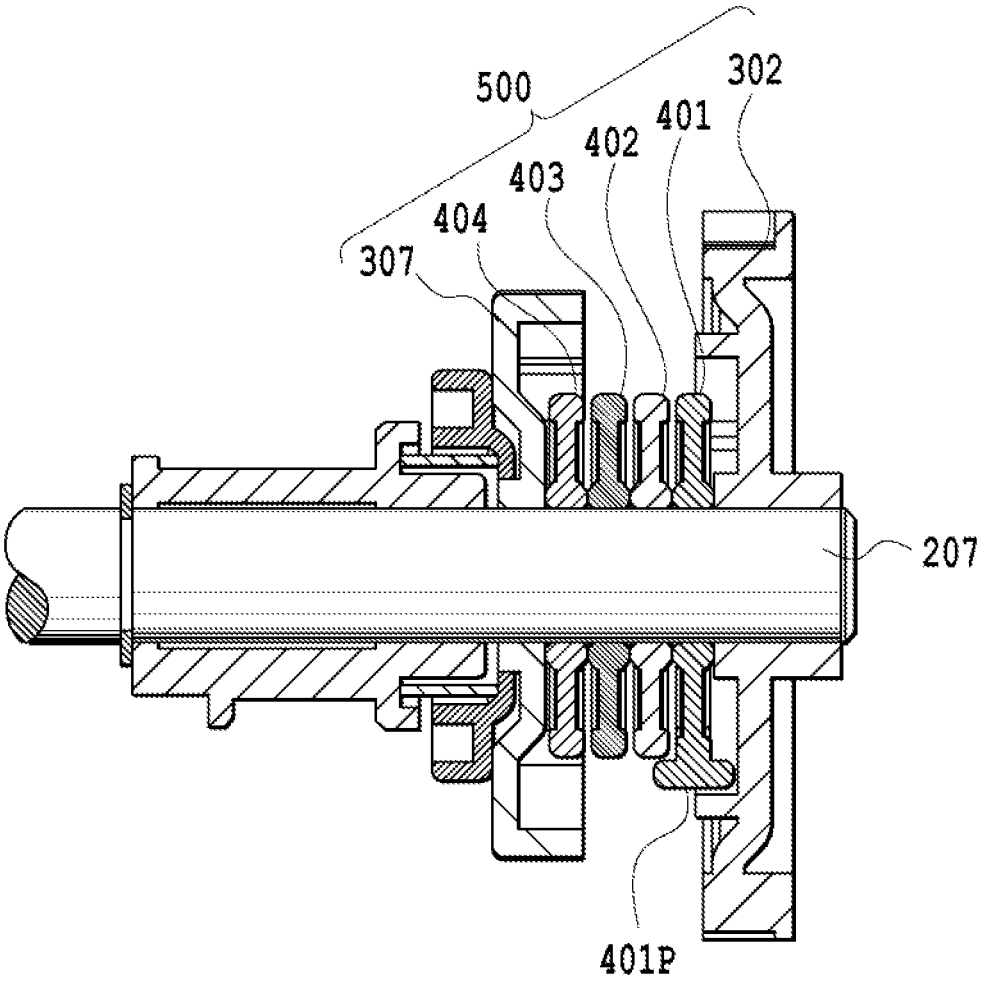
FIG. 5 is a cross-sectional view of the delay mechanism shown in FIG. 4.

A delay mechanism shown in FIGS. 4 and 5 is employed to transmit a rotational force from the discharging roller 207 to the discharging roller cam 307. According to the printing apparatus 10 for this embodiment, the conveying motor 301 is employed as a drive source for the sheet feeding unit and the recovery unit that maintains or recovers the ejection performance of the print head 3, and even during the operation of the recovery unit, the mechanism rotates the conveying roller 201 and the discharging roller 207. Therefore, a delay mechanism is provided so the discharge tray 1 is not unexpectedly opened during the operation of the recovery unit.

The delay mechanism that transmits a drive force from the discharging roller 207 to the discharging roller cam 307 will now be described while referring to FIGS. 4 and 5. FIG. 4 is a perspective view of the delay mechanism of the printing apparatus 10 of this embodiment, and FIG. 5 is a cross-sectional view of the discharging roller 207, the discharging roller cam 307 and the delay mechanism. The delay mechanism includes four ring-like members 401 to 404 and the discharging roller gear 302, all of which are attached coaxially with the discharging roller 207 so as to be rotatable. Protrusions 401P to 404P are provided, respectively, for the ring-like members 401 to 404.

The discharging roller gear 302 is fixed to the discharging roller 207 to transmit, to the discharge roller 207, a rotational force that is received from the conveying motor 301 via the conveying roller gear 304 and the idler gear 303. Therefore, the discharging roller gear 302 is rotated completely in synchronization with the discharging roller 207. Further, the four ring-like members 401 to 404 and the discharging roller cam 307 are supported so that they are rotatable and slidable along the discharge roller 207. When the discharging roller gear 302, the ring-like members 401 to 404 and the discharging roller cam 307 are brought into contact with each other at their protrusions, the rotational force of the discharging roller gear 302 is sequentially transmitted to the ring-like members 401 to 404, and finally to the discharging roller cam 307.

A mechanism for generating a delay by using the delay mechanism and a mechanism for accumulating a delay will now be described. When the conveying motor 301 rotates forward, the discharging roller 207 and the discharging roller gear 302 are rotated forward in synchronization with the conveying motor 301, and during a period continuing until the discharging roller gear 302 has made one rotation, the protrusion (not shown) of the discharging roller gear 302 and the protrusion 401P of the ring-like member 401 contact each other. As a result, the discharging roller gear 302 and the ring-like member 401 begin to rotate forward in synchronization with each other. Furthermore, during a period continuing until the ring-like member 401 has made one rotation, the protrusion 401P of the ring-like member 401 and the protrusion 402P of the ring-like member 402 contact each other, and the ring-like members 401 and 402 begin to rotate forward in synchronization with each other. This operation is continued in the same manner, and the ring-like members 403 and 404 also rotate forward in synchronization with the adjacent ring-like member and the discharging roller gear 302, respectively. As a result, the protrusion 404P of the ring-like member 404 and the protrusion (not shown) of the discharging roller cam 307 lastly contact each other, and the discharging roller 207, the discharging roller gear 302, the ring-like members 401 to 404 and the discharging roller cam 307 are rotated forward in synchronization with each other.

As described above, for the transmission of a rotational force from the discharging roller 207 to the discharging roller cam 307, there is a time lag that continues until the adjacent protrusions contact each other and cause synchronous rotation. That is, there is a period (a rotational angle) in which the discharging roller 207 rotates, while the discharging roller cam 307 does not rotate. This period is employed as a source for generating a delay.

When the conveying motor 301 rotates in reverse, the discharging roller 207 and the discharging roller gear 302 are reversely rotated in synchronization with the conveying motor 301. As a result, in the same manner as when the conveying motor 301 rotates forward, the discharging roller gear 302, the ring-like members 401 to 404 and the discharging roller cam 307 are sequentially and synchronously rotated, with a delay, and finally, the discharging roller cam 307 begins to rotate in reverse. The state wherein the discharging roller cam 307 is rotated in reverse in synchronization with the reverse rotation of the discharging roller 207 is the state wherein, when the conveying motor 301 is next rotated forward, the longest period (the greatest rotational angle) continues until the discharging roller 207 and the discharging roller cam 307 are rotated synchronously. That is, the state wherein the discharging roller 207 and the discharging roller cam 307 are rotated synchronously by being rotated in reverse of the conveying motor 301 is the state wherein the maximum length of a delay continuing until the discharge tray 1 is open is accumulated. In this embodiment, the maximum length of a delay is about the equivalent of a period for making four rotations of the discharging roller 207. Furthermore, when the conveying motor 301 reversely rotates, an arbitrary length of a delay that is equal to or smaller than the maximum length of a delay can also be accumulated.

Figure 7:
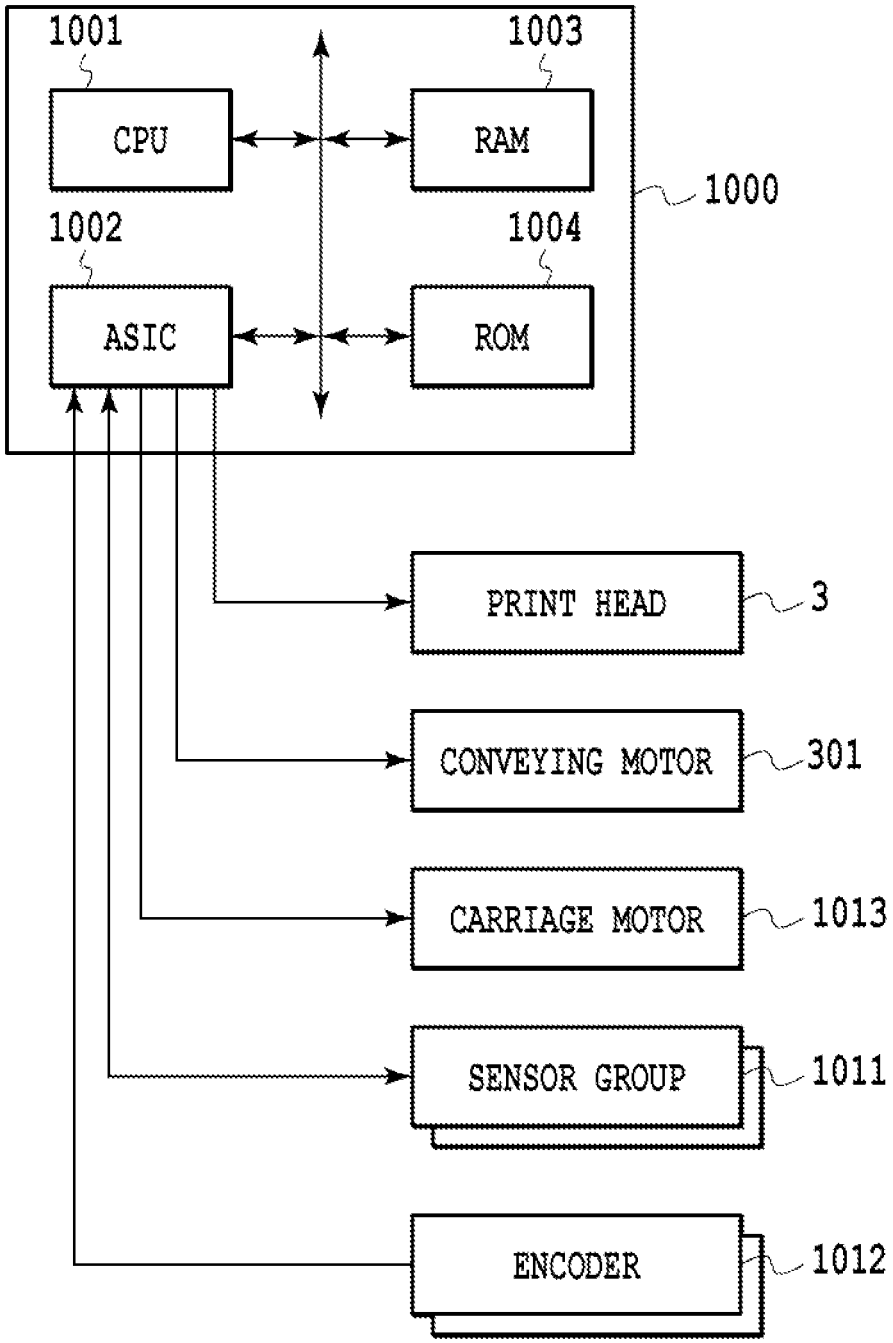
FIG. 7 is a schematic block diagram illustrating the arrangement of the control system of the printing apparatus according to the embodiment.

FIG. 7 is a schematic block diagram illustrating the arrangement of the control system of the printing apparatus 10 in this embodiment. A controller 1000 for this embodiment includes a CPU 1001 that performs the general control and operation for the printing apparatus 10. The controller 1000 also includes: an ASIC 1002 that performs computations by using hardware; a RAM 1003 that is employed for temporarily storing various data and variables; and a ROM 1004 wherein programs executed by the CPU 1001 for printer operation are stored. Furthermore, the controller 1000 receives detection signals from a sensor group 1011 consisting of various sensors, including the PE sensor 205, and also receives a signal from an encoder 1012. The ASIC 1002 and the CPU 1001 each perform processing based on the outputs of the sensor group 1011 and the encoder 1012, and drive the conveying motor 301, a carriage motor 1013 and the print head 3.

Figure 8:
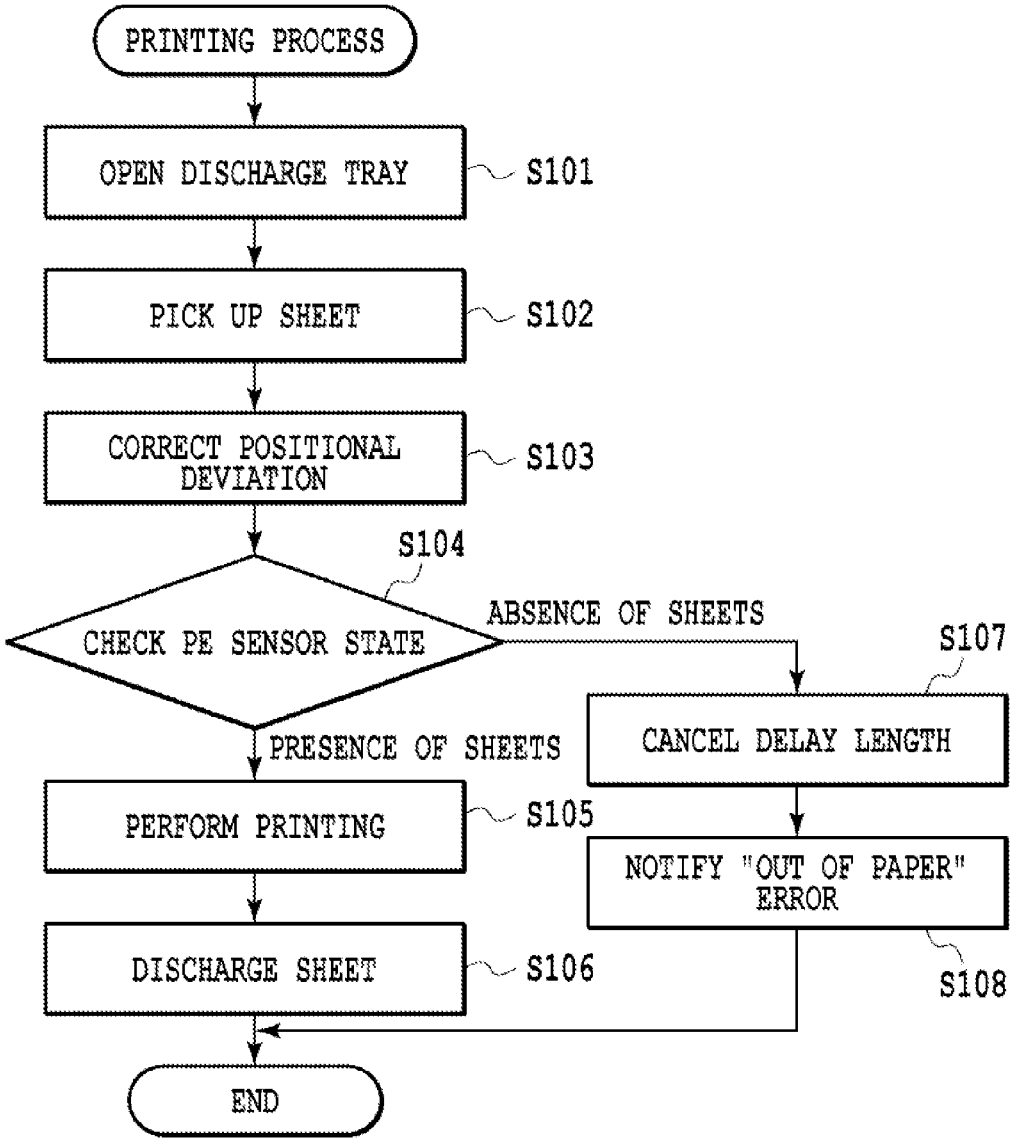
FIG. 8 is a flowchart showing the printing operation of the printing apparatus of the embodiment.

The printing processing performed by the controller 1000, provided for the printing apparatus 10 of this embodiment, will now be described while referring to the flowchart in FIG. 8. In this embodiment, an explanation will be given by employing, as an example, the performance of a positional deviation correction process for bringing the leading edge of a sheet into contact with the conveying roller 201, which is being reversely rotated, so that the leading edge of the sheet is aligned with the conveying roller 201.

When a printing instruction is issued to the printing apparatus 10 by an external apparatus, for example, first, at S101, the controller 1000 rotates the conveying motor 301 forward, so that the discharging roller 207 will be rotating forward. As a result, the length of a delay, accumulated and held in the delay mechanism 500 until a printing operation start instruction is issued, is canceled, and the discharge tray 1 is opened. The amount of rotation of the discharging roller 207 at this time is set while the state wherein the maximum length of a delay is accumulated is taken into account, along with among the other states available before a printing operation is performed. As the amount of rotation (forward rotation) at S101, the maximum, accumulated length of a delay that can be held in the delay mechanism 500 can also be set. In this case, however, the amount of rotation to be set must be greater than the amount of rotation that is required for canceling the length of a delay actually accumulated before a printing operation is started. At this time, the rotational speed of the discharging roller 207 for opening the discharge tray 1 must be lower than the rotational speed employed for the feeding operation, so that the discharge tray 1 will not be too suddenly and quickly opened. As a result, a longer operating period of time is required at S101 to rotate the discharging roller 207, and accordingly, the throughput for the printing processing could be adversely affected. Therefore, in this embodiment, the amount of forward rotation is set at S101 by assuming the maximum value of the length of a delay that has been accumulated before the printing operation is started, and during this process, the discharging roller 207 is rotated at a low speed so that the discharge tray 1 is opened slowly.

At S102, sheets mounted in the sheet stacking unit 2 are picked up, one by one, by the pickup roller 203, and each sheet is conveyed to a location where the sheet is to be held by the pair of sheet feeding rollers 202. At step S103, the sheet feeding roller 202 is rotated forward to convey the sheet toward the conveying roller 201. At this time, since the conveying motor 301 is reversely rotating, the conveying roller 201 and the discharging roller 207 are also rotated reversely. For the sheet feeding roller 202 and the pickup roller 203, the conveying motor 301 is also employed as a drive source; however, the forward rotation of the sheet feeding roller 202 and the pickup roller 203 is performed by changing transmission gears (not shown).

At S104, detection of the sheet by the PE sensor 205 is examined to determine whether the sheet was picked up normally. In a case wherein the leading edge of the sheet is detected by the PE sensor 205, it is ascertained that the sheet was picked up normally, and therefore, after the leading edge of the sheet has been detected by the PE sensor 205 (S104), the sheet is conveyed a predetermined distance, and is struck against the conveying roller 201 that is being reversely rotated. Since the sheet feeding roller 202 continues to feed the sheet through forward rotation, a loop is formed in the sheet, and the leading edge of the sheet becomes parallel to the conveying roller 201, so that the positional deviation of the sheet is corrected.

After the positional deviation has been corrected, at S105, the conveying motor 301 is changed from reverse rotation to forward rotation to perform a cue operation for conveying the sheet to the printing start position, and thereafter, the printing operation is begun. For the printing apparatus 10 of this embodiment, the printing and scanning operation, during which the print head 3 ejects ink by moving the carriage 4 where the print head 3 is mounted in a direction perpendicular to the sheet conveying direction, and the sheet conveying operation by forward rotation of the conveying roller 201, are alternately and repetitively performed to provide an image on the sheet. At S106, the sheet on which the image has been printed is discharged to the discharge tray 1, which has already been opened, and thereafter, the printing operation is terminated. At the time at which printing of an image has been completed, the conveying roller 201 is sequentially rotated forward in the printing process at S105 and the sheet discharging process at S106, and synchronously, the discharging roller 207 is also rotated forward. As a result, the length of a delay accumulated in the delay mechanism 500 is canceled.

In a case wherein the sheet is not detected by the PE sensor 205 at S104, and therefore, it is ascertained that the sheet is absent, program control moves to the process at S107. At this stage, until the state of the PE sensor 205 has been identified at S104, it can not be actually determined whether or not the sheet could be picked up, regardless of whether the picking up of the sheet has failed at S102 because, for example, there are no sheets in the sheet stacking unit 2. Therefore, until the state of the PE sensor 205 has been identified, forward rotation of the pickup roller 203 at S102 and forward rotation of the sheet feeding roller 202 at S103 are continued in the same manner as in a case wherein a sheet has normally been picked up. At this time, the amount of rotation of the sheet feeding roller 202 at S103 is equivalent to the sheet conveying distance required before the leading edge of the sheet, held between the sheet feeding roller 202 and the driven roller, has exactly reached the PE lever 204. Assuming that the sheet feeding roller 202 is rotated forward the designated amount, the discharging roller 207 is reversely rotated in synchronization with the feeding roller 202, and the maximum length of a delay is accumulated in the delay mechanism 500. As described above, a greater value is designated for the maximum length of a delay than for the amount of forward rotation performed at S101. Therefore, in a case wherein the printing operation was halted under the condition wherein the maximum length of the delay has been accumulated, and is restarted after a supply of sheets has been provided, at S101, slow rotation is ended before the maximum length of a delay is canceled, and thereafter, the discharging roller 207 begins to rotate at the same high speed as that for the printing operation. As a result, the discharge tray 1 is pivoted quickly and makes a large sound when it is opened, and compared with a case wherein the discharge tray 1 is opened slowly, the quality of a product and noise reduction are degraded.

Therefore, in this embodiment, when an "Out of Paper" error has occurred at S104, program control moves to S107, and the discharging roller 207 is rotated forward to cancel the maximum length of a delay that is accumulated in the delay mechanism 500. AS a result, in a case wherein the "Out of Paper" error is corrected and the printing operation is restarted, even when the discharge tray 1 is still closed, the discharge tray 1 can be opened slowly at an appropriate timing at S101 because the maximum length of a delay accumulated in the delay mechanism 500 has already been canceled. Further, the amount of forward rotation of the discharging roller 207 performed at S107 may be the amount of rotation required to cancel the length of a delay that has accumulated in the delay mechanism 500 by this time. Thereafter, at S108, notification of the occurrence of an "Out of Paper" error is provided for the user, and the processing is terminated.

As described above, according to the printing apparatus 10 of this embodiment, in a case wherein the sheet pick up operation is performed for printing and no sheets are present in the sheet stacking unit 2, the discharging roller 207 is rotated forward to cancel the length of a delay accumulated in the delay mechanism 500. Therefore, the discharge tray 1 can be slowly opened at a proper timing, and the throughput for the printing processing and the noise reduction for the apparatus can be improved.

For this embodiment, a so-called serial type inkjet printing apparatus, which performs printing by moving the print head in a direction perpendicular to the sheet conveyance direction, has been employed as an example printing apparatus. However, the present invention can be applied for an ink jet printing apparatus other than the serial type. For example, the present invention can be applied for a full-line type ink jet printing apparatus that prepares, at a predetermined location, a print head wherein nozzles are arranged within a range equal to or greater than the width of a sheet, and that sequentially moves the sheet relative to the print head. Furthermore, the present invention can also be applied for a printing apparatus other than an ink jet printing apparatus, such as an electrophotographic printing apparatus that has a discharge tray that can be pivoted between an open and a closed position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-202639, filed Sep. 14, 2012, which is hereby incorporated by reference herein in its entirety.

What is claimed is:

1. A printing apparatus comprising:

a printing unit configured to print on a sheet;

a conveying roller that is located upstream of the printing unit in a sheet conveying direction, and which conveys the sheet;

a conveying motor that drives the conveying roller;

a feeding roller that is located upstream of the conveying roller in the sheet conveying direction, and which is driven by the conveying motor to feed the sheet to the conveying roller, the feeding roller feeding the sheet to the conveying roller when the conveying motor reversely rotates;

a discharging roller that is located downstream of the printing unit in the sheet conveying direction, and which is driven by the conveying motor to discharge the sheet, the discharging roller discharging the sheet when the conveying motor forwardly rotates;

a discharge tray that is mounted on a main body, and that is movable between an open position and a closed position, for holding sheets that are discharged outside the main body, the discharge tray moving from the closed position to the open position by transmitting the drive force from the discharging roller to the discharge tray;

a delay mechanism for providing a delay before transmitting a rotational force of the discharging roller to the discharge tray, wherein, when the discharging roller is rotated in reverse, the delay mechanism accumulates the length of delay, and when the discharging roller is rotated forward for a period longer than the length of a delay that has been accumulated, opens the discharge tray;

a detection unit that is located between the feeding roller and the conveying roller and which detects a leading edge of the sheet; and a control unit configured to forwardly drive the conveying motor a predetermined amount, in the case where the detection unit cannot detect the sheet, even if the feeding roller rotates a predetermined amount.

2. The printing apparatus according to claim 1, wherein the conveying roller rotates forward or in reverse in synchronization with the forward or the reverse rotation of the discharging roller, and conveys to the printing unit a sheet that has been fed by the sheet feeding unit, and wherein the sheet feeding operation accompanied by the reverse rotation of the discharging roller is an operation during which positional deviation of the sheet is corrected by bringing the leading edge of the sheet into contact with the conveying roller, the rotation of which is linked with the reverse rotation of the discharging roller.

3. The printing apparatus according to claim 1, wherein the conveying motor is employed in common as a drive source for the discharging roller and the sheet feeding unit.

4. The printing apparatus according to claim 1, wherein the delay mechanism includes a discharging roller gear that is rotated with the discharging roller and ring-like members that are rotatably supported by the discharging roller; and wherein the ring-like members are rotated, with a delay having a predetermined length in accord with the rotation of the discharging roller.

5. A control method, for a printing apparatus that includes a printing unit for printing on a sheet, a conveying roller that is located upstream of the printing unit in a sheet conveying direction, a conveying motor that drives the conveying roller, a feeding roller that is located upstream of the conveying roller in the sheet conveying direction and which feeds the sheet when the conveying motor rotates reversely, a discharging roller for rotating forward and discharging outside a main body of the printing apparatus a sheet that has been printed by the printing unit, a discharge tray that is pivotally mounted on the main body, between an open position and a closed position, for holding sheets that are delivered outside the main body, and a delay mechanism, for providing a delay before transmitting a rotational force of the discharging roller to the discharge tray, so that when the discharging roller is rotated in reverse, the delay mechanism accumulates the length of a delay, and when the discharging roller is rotated forward for a period longer than the length of a delay that has been accumulated, opens the discharge tray, and a detection unit, the method comprising:

a determination step of determining with the detection unit whether feeding of a sheet is being performed during a sheet feeding operation accompanied by reverse rotation of the discharging roller; and a control step, in a case wherein it has been ascertained that the feeding of a sheet is being performed, of forwardly driving the conveying motor a predetermined amount, in the case where the detection unit cannot detect the sheet, even if the feeding roller rotates a predetermined amount.

* * * * *